United States Patent [19]

Krishnamurthy et al.

[11] Patent Number: 4,518,708

[45] Date of Patent: May 21, 1985

[54] PRETREATMENT OF A FRESH IRIDIUM-CONTAINING CATALYST

[75] Inventors: Sowmithri Krishnamurthy, West Deptford; George R. Landolt, Audubon; Hans J. Schoennagel, Lawrenceville, all of N.J.

[73] Assignee: Mobil Oil Corporation, New York, N.Y.

[21] Appl. No.: 586,640

[22] Filed: Mar. 7, 1984

Related U.S. Application Data

[63] Continuation-in-part of Ser. No. 385,158, Jun. 4, 1982, abandoned.

[51] Int. Cl.[3] ..... B01J 27/10; B01J 27/08; B01J 23/46; B01J 27/32

[52] U.S. Cl. ..... 502/230; 208/139; 208/140; 502/35; 502/37; 502/74; 502/334

[58] Field of Search ..... 208/140; 502/230, 35, 502/37, 74, 334

[56] References Cited

U.S. PATENT DOCUMENTS

| | | | |
|---|---|---|---|
| 2,785,138 | 3/1957 | Milliken, Jr. | 252/415 |
| 3,761,390 | 9/1973 | Greenwood et al. | 208/140 |
| 3,904,510 | 9/1975 | Sinfelt et al. | 252/415 |
| 3,986,982 | 10/1976 | Crowson et al. | 502/37 |
| 3,998,755 | 12/1976 | Hayes | 252/415 |
| 4,018,670 | 4/1977 | Sinfelt et al. | 208/139 |
| 4,133,743 | 1/1979 | Boret et al. | 252/415 |

FOREIGN PATENT DOCUMENTS

| | | | |
|---|---|---|---|
| 0009309 | 1/1979 | European Pat. Off. . | |
| 2325289 | 4/1977 | France | 502/37 |
| 2020993 | 5/1979 | United Kingdom . | |

*Primary Examiner*—P. E. Konopka
*Attorney, Agent, or Firm*—A. J. McKillop; M. G. Gilman; J. F. Powers, Jr.

[57] ABSTRACT

In a process for treatment of a fresh iridium-containing catalyst, the improvement consists of a three step procedure in sequence including treatment with oxygen, treatment with hydrogen chloride, and treatment with a reducing agent such as hydrogen.

11 Claims, 2 Drawing Figures

PRETREATMENT OF A FRESH IRIDIUM-CONTAINING CATALYST

This application is a continuation-in-part of application Ser. No. 385,158, filed June 4, 1982, now abandoned.

BACKGROUND OF THE INVENTION

1. Field of the Invention

The present invention relates to a method for treating fresh iridium-containing reforming catalysts.

2. Description of the Prior Art

The methods of preparation of metal-containing hydrocarbon conversion catalysts are well-known to the prior art. Much of the patent literature in this field relates to the regeneration of spent catalysts to impart a performance similar to that of a fresh or untreated catalyst. U.S. Pat. No. 3,998,755 discloses a series of treatment steps which may be performed on either a deactivated catalyst which is being regenerated or a fresh catalyst as part of the pretreatment procedure. The treatment procedure consists basically of a drying step at 200–600° F. for 2 to 24 hours, a calcination step at 700–1100° F. for 5 to 10 hours, and a water-free reduction step at 800–1100° F.

U.S. Pat. No. 3,941,682 discloses a method of treating a catalyst which can be applied to either a spent or a fresh catalyst which comprises drying the catalyst at 220–250° F. followed by a calcination step at 500–700° F. This patent notes that calcination temperatures in excess of 700° F. should be avoided. The drying and calcination steps may be followed by contact with hydrogen chloride or reduction with hydrogen.

SUMMARY OF THE INVENTION

The present invention involves a simple, straightforward technique for pretreating iridium catalysts to impart a performance equal to or superior to a fresh or untreated catalyst. The process for treatment includes three steps in sequence: treatment with oxygen, treatment with a hydrogen halide, and reduction with hydrogen. The oxygen and hydrogen halide steps may also be accomplished simultaneously.

As has heretofore been stated, the prior art discloses that oxygen exposure of fresh iridium-containing reforming catalysts is harmful.

The present invention assures that the iridium component of the catalyst will be placed in the proper oxidation state prior to final reduction.

DESCRIPTION OF THE INVENTION

Figure 1:
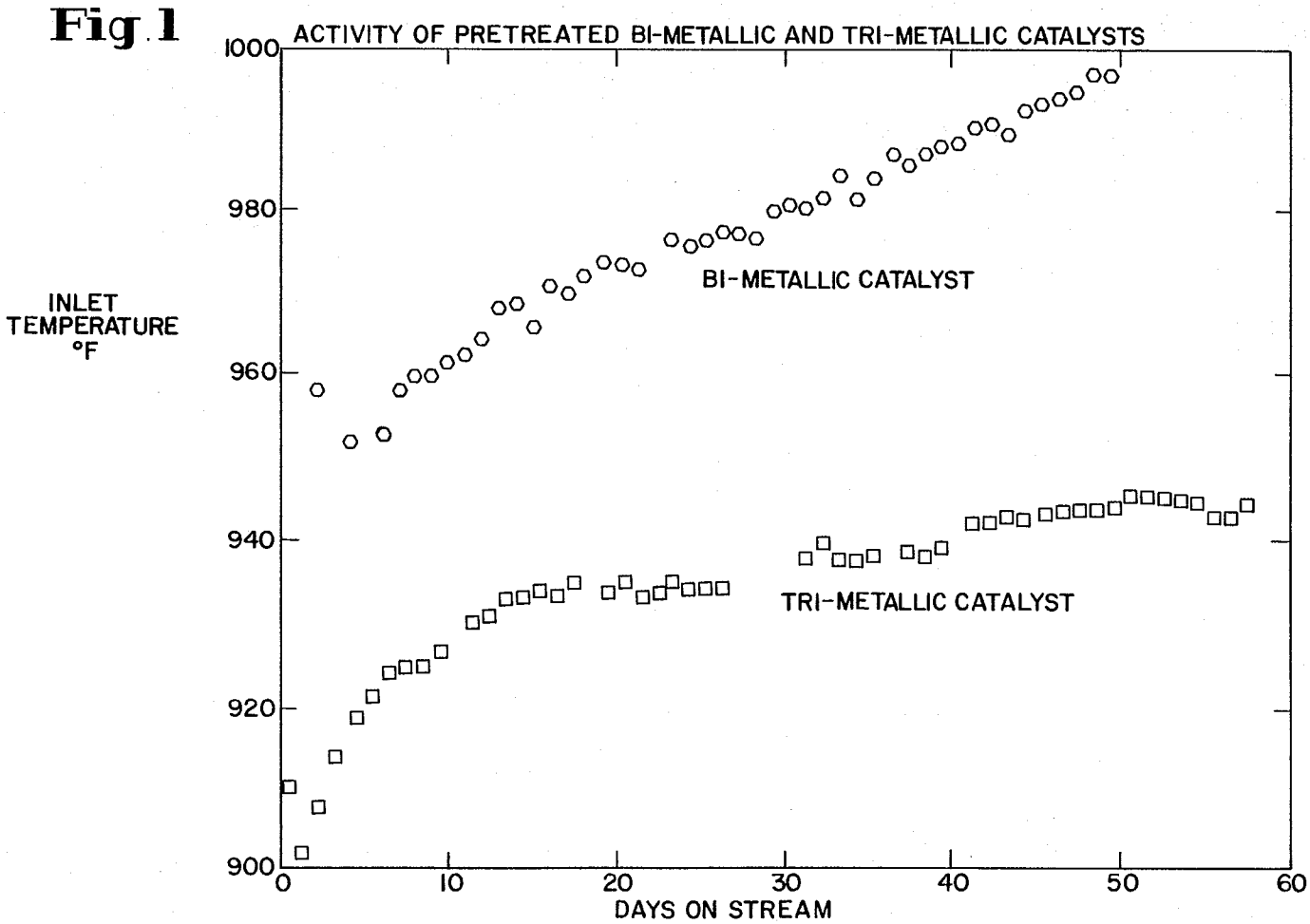
FIG. 1 shows a comparison of the inlet temperatures versus days on stream for Example 8.

The process of this invention is carried out by treating a fresh reforming catalyst prepared from hexachloroiridic with an oxygen-containing gas at elevated temperatures. A fresh catalyst is defined as one which contains the metal in the state that is obtained immediately after impregnation and calcination and prior to reduction. Suitable conditions range from temperatures of 750–1000° F. and oxygen concentrations can range from about 0.1–50 wt. % for about 0.1 to 24 hours. Preferably, this step is accomplished by treating the fresh catalyst with about 0.1–21 wt. % of oxygen at temperatures of about 850–950° F. for about 0.25 to 2 hours at atmospheric pressure. The treatment with oxygen can be carried out at pressure ranging from about 0.1–500 psig.

The next step which is followed in sequence involves the addition of a dry hydrogen halide, preferably hydrogen chloride, to the catalyst. The expression "dry hydrogen halide" is intended to mean that water is controlled to a level no greater than 1/30 the concentration of hydrogen halide. Preferably, water is present at a level no greater than 10 ppm. As an example, commercially available hydrogen chloride is suitable as is, i.e. no drying step is necessary. The treatment with dry hydrogen halide is carried out at temperatures ranging from about 700–1000° F. for a period of time ranging from about 0.5 to about 24 hours utilizing at least 0.1 wt. % of hydrogen halide per weight of catalyst per hour. The amount of hydrogen halide used is generally no greater than about 10 wt. % per weight of catalyst per hour since higher amounts, although operable, are not necessary to obtain the desired results. Preferably, hydrogen chloride with a concentration of about 3 vol. % in an inert gas is added at 1.5 wt. % of hydrogen chloride per weight of catalyst per hour at a temperature of about 850° F. to about 950° F. for about 2 hours at atmospheric pressure. The treatment with dry hydrogen chloride can be carried out at pressures ranging from about 0.1–500 psig. The foregoing steps may also be accomplished simultaneously with the same results.

The final pretreatment step consists of treating the catalyst with a reducing agent, e.g. hydrogen. Conditions include temperatures ranging from 400–1100° F. for periods of time ranging from 0.1 to 24 hours. Preferably, this procedure is performed at a temperature of about 850–950° F. for about 0.5 to 2 hours at atmospheric pressure. It is to be understood that this last step, i.e. reduction with hydrogen, can be carried out either as a separate step or can be carried out as part of the reformer start-up procedure. It is important to note that the presence of water during any of the three pretreatment steps is detrimental to the formation and performance of the catalyst.

In a particularly preferred embodiment of this invention, the treatment in step 1 (oxygen) and step 2 (hydrogen halide) is carried out by mixture of the same with an inert diluent such as nitrogen, neon, helium, argon, etc. The amount of inert gas is not critical and can range from about 50 to 99.9 vol. % based on oxygen and can range from about 90 to 99.9 vol. % based on the dry hydrogen halide.

The iridium-containing catalysts of the present invention comprise a porous carrier or support material in combination with iridium and other metals such as platinum and rhenium. The support component of the catalyst is preferably a porous, adsorptive material having a surface area, as determined by the Brunauer-Emmit-Teller (BET) method, of about 20–800, preferably 100–300 square meters per gram. This support material should be substantially refractory at the temperature and pressure conditions utilized in any given hydrocarbon conversion process. Useful support materials include: (a) silicon-based materials such as silica or silica gel, silicon carbide, clays, natural or synthetic silicates such as kieselguhr, kaolin, china clay, Attapulgus clay, etc.; (b) aluminosilicate zeolite materials such as naturally occurring or synthetic erionite, mordenite, faujasite, etc. that may or may not be previously converted to a hydrogen or ammonium form and reduced in soda content by virtue of an exchange reaction with various metal cations, including rare earth metal cations; (c) refractory inorganic oxides, including alumina, titanium dioxide, zinc oxide, magnesia, thoria, chromia, silica-alumina, alumina-titania, silica-zirconia, alumina-chromia, etc.; and (d) mixtures of one or more of the materials referred to above.

Refractory inorganic oxide materials are preferred catalyst support materials. In general, superior results are obtained when alumina, in particular the gamma or eta forms, is employed. Alumina is the preferred catalyst support material when the catalyst is employed in naphtha reforming operations. The support materials described above are known articles of commerce and can be prepared for use as catalyst constituents by many varied techniques. Typically, the support materials are prepared in the form of spheres, granules, powders, extrudates or pellets. The precise size or shape of the support material used is dependent upon many engineering factors not within the purview of the instant invention. It is also within the scope of this invention to have all the metals of the iridium-containing catalyst on the same support in one particle, e.g. platinum and iridium on alumina, or as a mixture of separate particle, e.g. platinum on alumina mixed with iridium on alumina. When mixtures of separate particles are used, the supports can be the same or different.

Iridium is generally present on catalysts employed in a naphtha reforming operation where the catalysts should contain greater than about 0.1 wt % iridium, based upon the dry weight of the total catalyst. For other types of operations, lesser quantities of iridium may be employed. Specifically, iridium and platinum may each be present on the catalyst in amounts varying from about 0.01 to about 5.0 wt %, preferably in amounts varying from about 0.1 to about 1.0 wt %, based upon the total weight of the dry catalyst. Iridium/platinum naphtha reforming catalysts having maximum effectiveness normally contain 0.2 to 0.6 wt % each, of iridium and platinum, based on total catalyst.

The iridium-containing catalysts may be prepared employing simple impregnation techniques well known in the art. Such a catalyst may be prepared by impregnating a support material with a solution of a soluble iridium compound and soluble compounds of any additional metals to be incorporated in the catalyst. Generally, an aqueous solution of the metal compounds is used. The support material may be impregnated with the various metal-containing compounds either sequentially or simultaneously. The carrier material is impregnated with solutions of appropriate concentration to provide the desired quantity of metals in the finished catalyst. In the case of iridium, compounds suitable for the impregnation onto the carrier include, among others, hexachloroiridic acid, acid, iridium tribromide, iridium trichloride, and ammonium chloroiridate, with hexachloroiridic acid being the preferred compound. The preferred catalyst manufacturing technique involves contacting a previously prepared support, such as alumina, with an aqueous solution of hexachloroiridic acid of appropriate concentration to provide the desired quantity of metal in the finished catalyst.

After impregnating the carrier, the composite catalyst is dried at a temperature varying from about 220–250° F. The catalyst may be dried in air at the above stated temperatures or may be dried by treating the catalyst in a flowing stream of inert gas, i.e. nitrogen. The fresh catalyst is then subjected to the pretreatment steps of this invention. The catalyst is dried in an oxygen-containing gas at a temperature of from about 850° F. to about 950° F. for about 0.25 to 2 hours. The drying step is followed by the treatment of hydrogen chloride for 2 hours at a temperature of from about 850° F. to about 950° F. If preferred, the foregoing steps may be accomplished simultaneously. The catalyst is next treated with reducing agent such as hydrogen for about 0.5 to 2 hours at a temperature of from about 850° F. to about 950° F.

The iridium-containing reforming catalysts is used to improve the octane quality of naphthas and straight run gasolines. In addition they may be used to promote a wide variety of hydrocarbon conversion reactions such as hydrocracking, isomerization, dehydrogenation, cracking and the like.

In a naphtha hydroforming process (reforming) a substantially sulfur-free naphtha stream that typically contains about 15 to 80 volume percent paraffins, 15 to 80 volume percent naphthenes and about 2 to 20 percent aromatics and boiling at atmospheric pressure substantially between about 80° F. and 450° F., preferably between about 150° F. and 375° F., is contacted with the iridium-containing catalyst composite in the presence of hydrogen. The reactions typically occur in a vapor phase at a temperature varying from about 650–1000° F., preferably about 750–980° F. Reaction zone pressures may vary from about 1 to 50, preferably from about 5 to 30 atmospheres. The naphtha feed stream is passed over the catalyst composite at space velocities varying from about 0.5 to 20 parts by weight of naphtha per hour per part by weight of catalyst (W/hr/W), preferably from about 1 to 10 W/hr/W. The hydrogen to hydrocarbon mole ratio within the reaction zone is maintained between about 0.5 and 20, preferably between about 1 and 10. During the reforming process, the hydrogen used may be an admixture with light gaseous hydrocarbons. In a typical operation, the catalyst is maintained as a fixed bed within a series of adiabatically operated reactors. The product stream from each reactor (except the last) in the reactor train is reheated prior to passage to the following reactor. As an alternate to the above-described process, the catalyst may be used in a moving bed in which the naphtha charge stock, hydrogen and catalyst are passed in parallel through the reactor or in a fluidized system wherein the naphtha feed stock is passed upwardly through a turbulent bed of finely divided catalyst particles. Finally, if desired, the catalyst may be simply slurried with the charge stock and the resulting mixture conveyed to the reaction zone for further reaction. The following examples illustrate further the pretreatment procedure of the present invention.

EXAMPLE 1

A deactivated reforming catalyst comprising:

| | Wt. % |
|---|---|
| Iridium | 0.3 |
| Platinum | 0.3 |
| Rhenium | 0.3 |

was regenerated in the following manner.

1. The spent catalyst was heated to 850° F. in the presence of 5% oxygen and 3% hydrogen chloride in a nitrogen atmosphere for 8 hours to remove the coke deposits from the catalyst.

2. The product of step 1 was treated with hydrogen for 0.5 hours at a temperature of 850° F.

All of the catalysts in this and the following examples were examined by Temperature Programmed Desorption (TPD) of hydrogen. TPD of hydrogen is a technique used for estimating metal dispersions on reforming catalysts. The procedure consists of chemisorbing hydrogen on the metals at room temperature and further desorbing it by applying heat at a programmed rate. By collecting the hydrogen desorbed and knowing the hydrogen to metal ratio, the metal dispersion can be calculated. Thus, a dispersion of 0.5 is equivalent to 50% of the total metal being exposed as surface metal. It has been found that a dispersion of at least 0.5 is necessary to effect reforming reactions. Typically, pretreated iridium-containing catalysts have dispersions in the range of 0.6 to 1.0. The nature of the desorption spectrum, which is a plot of the rate of hydrogen release with respect to temperature as a function of temperature, provides additional information on the state of the metals on the support.

The resulting catalyst of Example 1 had a dispersion of less than 0.5. The pretreatment procedure therefore does not work well with a deactivated or spent catalyst.

EXAMPLE 2

A fresh reforming catalyst comprising:

| | Wt. % |
|---|---|
| Iridium | 0.3 |
| Platinum | 0.3 |

was pretreated in the following manner.

1. The fresh catalyst was heated to a temperature of 850° F. in the presence of 5% oxygen and 3% hydrogen chloride in nitrogen and water for 2 hours. A water: hydrogen chloride molar ratio of 5.6:1 was maintained during this period.

2. The product of step 1 was treated in hydrogen under dry conditions for 0.5 hours at a temperature of 850° F.

The resulting catalyst had a dispersion of less than 0.5. Therefore the presence of water is detrimental to the pretreatment procedure.

EXAMPLE 3

A fresh reforming catalyst comprising:

| | Wt. % |
|---|---|
| Iridium | 0.3 |
| Platinum | 0.3 |
| Rhenium | 0.3 |

was pretreated in the following manner.

1. The fresh catalyst was heated at a temperature of 950° F. in 5% oxygen in a nitrogen atmosphere for 0.5 hours.

2. The product of step 1 was further treated in 3.09% hydrogen chloride in nitrogen at 1.5 wt % hydrogen chloride per weight of catalyst per hour for 2 hours at 950° F.

3. The product of step 2 was treated with hydrogen for 1 hour at a temperature of 950° F.

The resulting catalyst had a dispersion of greater than 0.5 which indicates that the pretreatment was successful.

EXAMPLE 4

A fresh reforming catalyst comprising:

| | Wt. % |
|---|---|
| Iridium | 0.3 |
| Platinum | 0.3 |
| Rhenium | 0.3 |

was pretreated in the following manner.

1. The fresh catalyst was heated at a temperature of 850° F. in nitrogen for 0.5 hours.

2. The product of step 1 was treated with 3.09% hydrogen chloride in nitrogen at 1.5 wt % nitrogen per weight of catalyst per hour for 2 hours at a temperature of 850° F.

3. The product of step 2 was treated with hydrogen for 1 hour at a temperature of 850° F.

The resulting catalyst had a dispersion of less than 0.5. The low dispersion clearly indicates the necessity of oxygen to effect the pretreatment.

EXAMPLE 5

The catalyst of Example 4 was treated in the same manner as Example 4 with the exceptions of substituting 900° F. and 950° F. in steps 1-3.

The resulting catalysts also had a dispersion of less than 0.5 which indicates the necessity of oxygen to effect the pretreatment.

EXAMPLE 6

A fresh reforming catalyst comprising:

| | Wt. % |
|---|---|
| Iridium | 0.3 |
| Platinum | 0.3 |
| Rhenium | 0.3 |

was pretreated in the following manner.

1. The catalyst was heated to a temperature of 950° F. in the presence of 3.09% hydrogen chloride in nitrogen at 1.5 wt % hydrogen chloride per weight of catalyst per hour.

2. The product of step 1 was treated with hydrogen for one hour at a temperature of 950° F.

The resulting catalyst had a dispersion of less than 0.5 which indicates the necessity of the presence of oxygen either before or with the hydrogen chloride treatment.

EXAMPLE 7

A fresh reforming catalyst comprising:

| | Wt. % |
|---|---|
| Iridium | 0.3 |
| Platinum | 0.3 |
| Rhenium | 0.3 |

was pretreated in the following manner.

1. The fresh catalyst was heated to a temperature of 850° F. in the presence of 5% oxygen in a nitrogen atmosphere and 1.5 wt % of 3.09% hydrogen chloride per weight of catalyst per hour for 2 hours.

2. The product of step 1 was treated with hydrogen for 1 hour at a temperature of 850° F.

The resulting catalyst had a dispersion of greater than 0.5. Therefore steps 1 and 2 of the pretreatment procedure can be accomplished sequentially (Example 3) or simultaneously.

EXAMPLE 8

A fresh reforming catalyst comprising:

| | Wt. % |
|---|---|
| Iridium | 0.3 |
| Platinum | 0.3 |
| Rhenium | 0.3 |

was pretreated as in Example 7 resulting in a dispersion of greater than 0.5 as determined by hydrogen chemisorption.

A commercial platinum-rhenium reforming catalyst (E603) having a composition of 0.35% platinum, and 0.35% rhenium was pretreated in a conventional manner using 5% oxygen in a nitrogen atmosphere for 2 hours at a temperature of 950° F. and subsequently treated with hydrogen for 1 hour at a temperature of 950° F. The pretreated bi-metallic and tri-metallic catalysts were then evaluated at an octane severity of 98 R+O for the reforming of a $C_6$-350° F. Arabian Light Naphtha having the following properties:

| | Volume % |
|---|---|
| Paraffins | 71.4 |
| Naphthenes | 17.5 |
| Aromatics | 11.1 |
| Sp. Gr. | 0.7324 |
| Sulfur, ppm | 0.2 |
| Nitrogen, ppm | 0.2 |

The reaction conditions were 250 psig, 2 WHSV and a total molar recycle ratio of 7. A comparison of the inlet temperatures versus days on stream is shown in FIG. 1. As can be seen, the pretreated tri-metallic catalyst has had exceptional stability in comparison to a conventional bi-metallic catalyst.

EXAMPLE 9

A fresh reforming catalyst comprising:

| | Wt. % |
|---|---|
| Iridium | 0.3 |
| Platinum | 0.3 |
| Rhenium | 0.3 |

was pretreated in accordance with Example 7.

A platinum-rhenium catalyst was pretreated with 1.93% chlorine in nitrogen at 1.5 wt % chlorine per weight of catalyst per hour for 2 hours at a temperature of 900° F. The iridium component was then added and the composite was treated in hydrogen for 1 hour at a temperature of 850° F.

The pretreated platinum-rhenium/fresh iridium catalyst and the platinum-rhenium/iridium catalyst pretreated in accordance with this invention were evaluated at an octane severity of 98 R+O for the reforming of $C_6$-350° F. Arabian Light Naphtha having the following properties.

| | Volume % |
|---|---|
| Paraffins | 71.4 |
| Naphthenes | 17.5 |
| Aromatics | 11.1 |
| Sp. Gr. | 0.7324 |
| Sulfur, ppm | 0.2 |
| Nitrogen, ppm | 0.2 |

Figure 2:
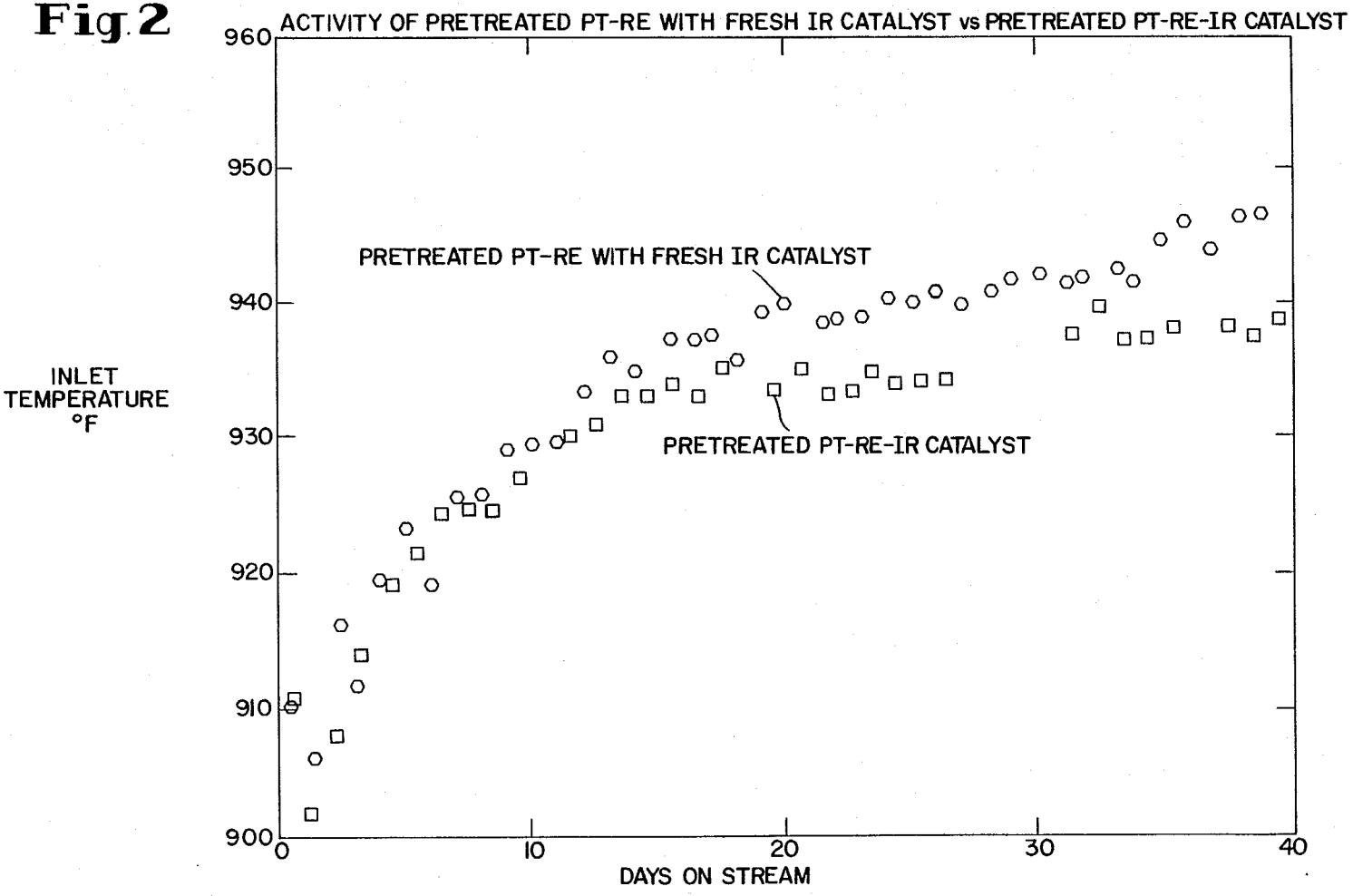
FIG. 2 shows the same comparison for Example 9.

The reaction conditions were 250 psig, 2 WHSV and a total molar recycle ratio of 7. A comparison of the inlet temperature versus days on stream is shown in FIG. 2. As can be seen, the pretreated catalyst according to this invention has an octane advantage of 10° F. after 40 days on the stream.

EXAMPLE 10

A bi-metallic catalyst comprising:

| | Wt. % |
|---|---|
| Iridium | 0.3 |
| Platinum | 0.3 |

was pretreated in accordance with Example 7.

The pretreated catalyst had a dispersion of greater than 0.5 which indicates that the pretreatment procedure was successful.

EXAMPLE 11

A commercial bi-metallic catalyst designated KX-130 having a composition comprising:

| | Wt. % |
|---|---|
| Iridium | 0.3 |
| Platinum | 0.3 |

was pretreated in accordance with Example 7 with the exception of the temperature which was maintained at a temperature of 850° F. in all steps.

The pretreated catalyst had a dispersion of greater than 0.5 which indicates that the pretreatment procedure was successful.

EXAMPLE 12

A fresh reforming catalyst comprising:

| | |
|---|---|
| Platinum | 0.3 wt. % |
| Iridium | 0.3 wt. % |
| Rhenium | 0.3 wt. % |

was pretreated according to the procedure in Example 7 with the exception that the fresh catalyst was first reduced in hydrogen for one hour at 450° C. The resulting catalyst had a dispersion <0.5 as determined by hydrogen chemisorption. Therefore, the prescribed pretreatment procedure is ineffective on a previously reduced reforming catalyst.

EXAMPLE 13

A fresh reforming catalyst comprising:

| | |
|---|---|
| Platinum | 0.3 wt. % |
| Iridium | 0.3 wt. % |

was pretreated according to the procedure in Example 7 resulting in a dispersion of greater than 0.5 (0.7) as determined by hydrogen chemisorption. The reduced catalyst was again subjected to the pretreatment procedure of Example 7. The resulting catalyst had a dispersion of greater than 0.5 (0.8), which indicates the multiple use of this procedure.

EXAMPLE 14

A fresh reforming catalyst comprising:

| | |
|---|---|
| Platinum | 0.3 wt. % |
| Iridium | 0.3 wt. % |
| Rhenium | 0.3 wt. % |

was pretreated according to the procedure in Example 7 with the exception that oxygen-chlorine was used instead of oxygen/hydrogen chloride in step 1. The resulting catalyst had a dispersion <0.5 as determined by hydrogen chemisorption which indicates the necessity of the presence of oxygen with a hydrogen halide to effect successful pretreatment.

What is claimed is:

1. In a method of preparing a fresh metal-containing reforming catalyst wherein a porous support is impregnated with an iridium compound in combination with other metals and thereafter dried, the improvement comprising increasing the dispersion of metals on said porous support prior to exposure to a reducing atmosphere by pretreating the catalyst with oxygen, dry hydrogen halide and a reducing agent in the following sequence of steps:

(1) contacting the catalyst with an oxygen-containing gas at temperatures of about 850–1000° F. with oxygen concentration of about 0.1–50 wt. % for about 0.1 to 24 hours.

(2) contacting the catalyst with dry hydrogen halide at temperatures ranging from about 700–1000° F. for about 0.5 to 24 hours utilizing at least 0.1 wt. % hydrogen halide per weight of catalyst per hour; and (3) contacting the catalyst with a reducing agent at temperatures ranging from 400–1000° F. for a period of time ranging from 0.1 to 24 hours whereby said dispersion of metals is such that at least 50% of the total metal is exposed as surface metal after pretreatment.

2. The process of claim 1 wherein said oxygen treatment step comprises treating said catalyst with from 0.1 to 21 wt. % of oxygen at a temperature of from 850–950° F. for about 0.25 to 2 hours.

3. The process of claim 2 wherein the oxygen is in admixture with an inert gas.

4. The process of claim 3 wherein said inert gas is nitrogen.

5. The process of claim 1 wherein said hydrogen halide treatment step comprises treating said catalyst with about 1.5% by weight of hydrogen chloride per weight of said catalyst per hour for about 2 hours at a temperature of from about 850–950° F.

6. The process of claim 5 wherein the hydrogen chloride is in admixture with an inert gas.

7. The process of claim 6 wherein said inert gas is nitrogen.

8. The process of claim 1 wherein said catalyst is treated with a reducing agent at a temperature of from about 850–950° F. for about 0.5–2 hours.

9. The process of claim 1 wherein said reducing agent is hydrogen.

10. The process of claim 1 wherein said catalyst contains the metals iridium and platinum.

11. The process of claim 1 wherein the catalyst contains the metals iridium, platinum and rhenium.

* * * * *